US005826318A

United States Patent [19]

Sullalti

[11] Patent Number: 5,826,318

[45] Date of Patent: Oct. 27, 1998

[54] FAST FEEDER UNIT FOR AN AUTOMATIC MACHINE FOR MACHINING THE CYLINDRICAL SURFACE OF BOTTLE CLOSURE CAPS

[75] Inventor: Loretto Sullalti, Imola, Italy

[73] Assignee: Sacmi Cooperativa Meccanici Imola S.c.r.l., Imola, Italy

[21] Appl. No.: 660,356

[22] Filed: Jun. 7, 1996

[30] Foreign Application Priority Data

Jun. 20, 1995 [IT] Italy ..... B095 A 000312

[51] Int. Cl.[6] ..... B23Q 7/02; B65D 41/34

[52] U.S. Cl. ..... 29/38 B; 413/10

[58] Field of Search ..... 29/38 B, 38 A; 53/296, 314, 334; 413/47, 48, 50, 10; 414/225, 783; 83/879, 880; 82/124

[56] References Cited

U.S. PATENT DOCUMENTS

| | | | |
|---|---|---|---|
| 1,885,703 | 11/1932 | Fink | 413/47 |
| 2,097,646 | 11/1937 | Rupple | 29/38 B |
| 2,353,349 | 7/1944 | Merolle | 72/94 |
| 3,238,908 | 3/1966 | Gilbert | 413/50 |
| 3,824,941 | 7/1974 | Hannon | 413/10 |
| 4,219,986 | 9/1980 | Osterbaus | 53/314 |
| 5,557,999 | 9/1996 | Smith et al. | 83/880 |
| 5,651,299 | 7/1997 | Boyle et al. | 413/10 X |

FOREIGN PATENT DOCUMENTS

| | | | |
|---|---|---|---|
| 617242 | 7/1978 | U.S.S.R. | 29/38 B |
| 1134825 | 11/1968 | United Kingdom . | |

*Primary Examiner*—William R. Briggs
*Attorney, Agent, or Firm*—Guido Modiano; Albert Josif

[57] ABSTRACT

A fast feeder unit for an automatic machine for machining the cylindrical surface of bottle closure caps, including a feeder carousel, which is provided with devices for supporting and rotationally actuating it coaxially and in step with the carousel of the machine and whereon a plurality of axially slidable stems are mounted; the stems direct, towards the chucks of the machine, respective half-shells for supporting the caps and are connected to respective axial translatory motion devices adapted to move the half-shells from a position that is spaced from the chucks and co-planar to the openings of a fixed guide for feeding the caps to be machined and of a fixed guide for removing the machined caps, to a position for fitting a cap on the chuck and a position for removing the cap from the chuck.

8 Claims, 5 Drawing Sheets

FAST FEEDER UNIT FOR AN AUTOMATIC MACHINE FOR MACHINING THE CYLINDRICAL SURFACE OF BOTTLE CLOSURE CAPS

BACKGROUND OF THE INVENTION

The present invention relates to a fast feeder unit for an automatic machine for machining the cylindrical surface of bottle closure caps.

Conventional automatic machines for machining the cylindrical surface of bottle closure caps are constituted by a rotatable carousel that supports a plurality of annularly distributed chucks, whereon cylindrical bottle closure caps are fitted; said caps can be for example drawn and made of aluminum, and the machine must perform thereon a plurality of machining operations (knurling, profiling, cutting, surface scoring); as an alternative, the caps may be made of a material such as plastics, and the machine must perform, for example, partial cutting to form the pilferproof ring.

Currently, caps are sequentially fitted on the chucks and then removed therefrom with substantially fixed feeder elements and with cam profiles, bevel cut chisels, or pushers that make the caps slide on or off the chucks: such devices considerably limit the operating speed that can be obtained with the machine and require a rather elongated path for feeding and removing the caps; one must in fact consider that especially aluminum drawn caps are rather delicate and must be handled carefully to avoid markings or surface dents which are absolutely not accepted by the user: this drawback of conventional machines becomes more significant when metal caps have to be machined which are used for example for certain high-proof spirits and have a considerable length (height).

SUMMARY OF THE INVENTION

A principal aim of the present invention is to obviate the above-mentioned drawbacks of conventional devices, i.e., to provide a fast feeder unit for an automatic machine for machining the cylindrical surface of bottle closure caps that is capable of working very quickly, effectively, and delicately even in the presence of very tall caps.

Within the scope of this aim, an object of the present invention is to achieve the above aim with a structure that is simple, relatively easy to execute in practice, safe in use, effective in operation, and has a relatively low cost.

This aim and this object are achieved by the present fast feeder unit for an automatic machine for machining the cylindrical surface of bottle closure caps, of the type having a continuously rotatable carousel whereon a plurality of annularly distributed chucks is rotatably mounted, the caps to be machined being fitted on said chucks, said unit being characterized in that it is constituted by a feeder carousel, which is provided with means for supporting and rotationally actuating it coaxially and in step with said carousel of the machine and whereon a plurality of axially slidable stems are mounted, said stems directing, towards the chucks, respective half-shells for supporting the caps and being connected to respective axial translatory motion means adapted to move the half-shells from a position that is spaced from the chucks and co-planar to the openings of a fixed guide for feeding the caps to be machined and of a fixed guide for removing the machined caps, to a position for fitting a cap on the chuck and a position for removing the cap from the chuck.

BRIEF DESCRIPTION OF THE DRAWINGS

Further characteristics and advantages will become apparent from the following detailed description of a preferred but not exclusive embodiment of a fast feeder unit for an automatic machine for machining the cylindrical surface of bottle closure caps according to the invention, illustrated only by way of non-limitative example in the accompanying drawings, wherein.

DESCRIPTION OF THE PREFERRED EMBODIMENTS

Figure 1:
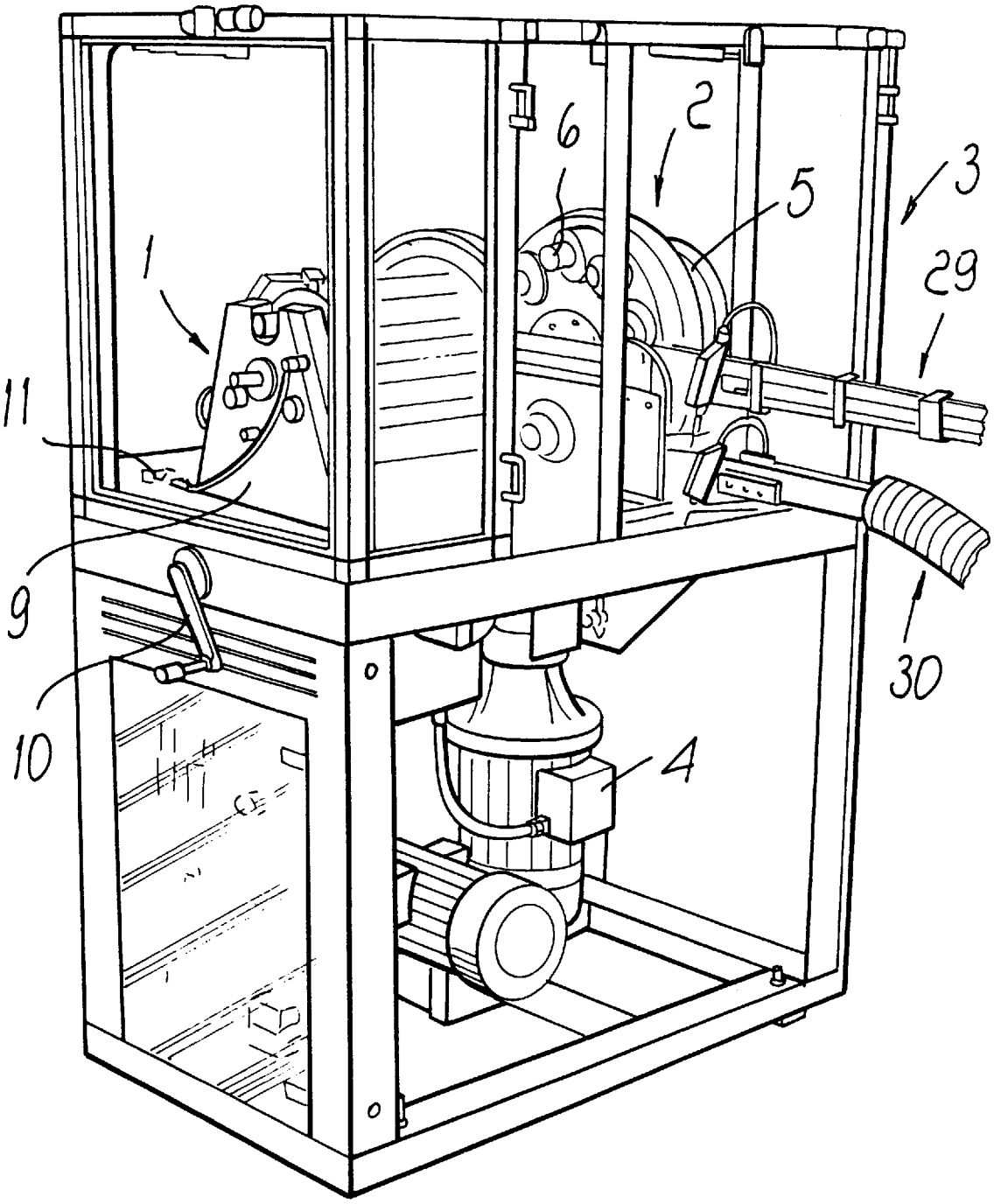
FIG. 1 is a perspective view of an automatic machine for machining the cylindrical surface of bottle closure caps, equipped with a fast feeder unit according to the invention.
Figure 2:
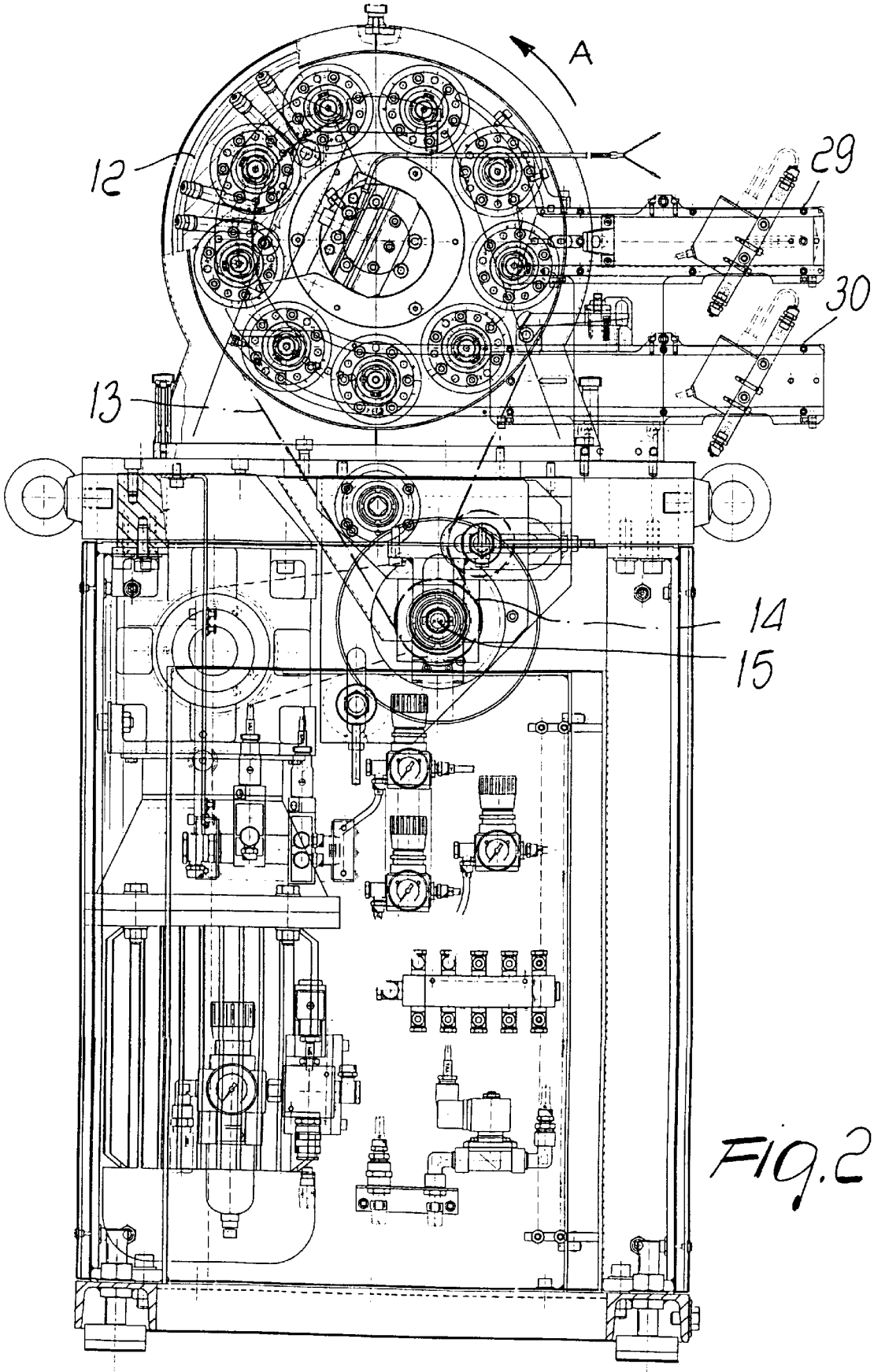
FIG. 2 is a partially sectional front view of a fast feeder unit according to the invention.
Figure 3:
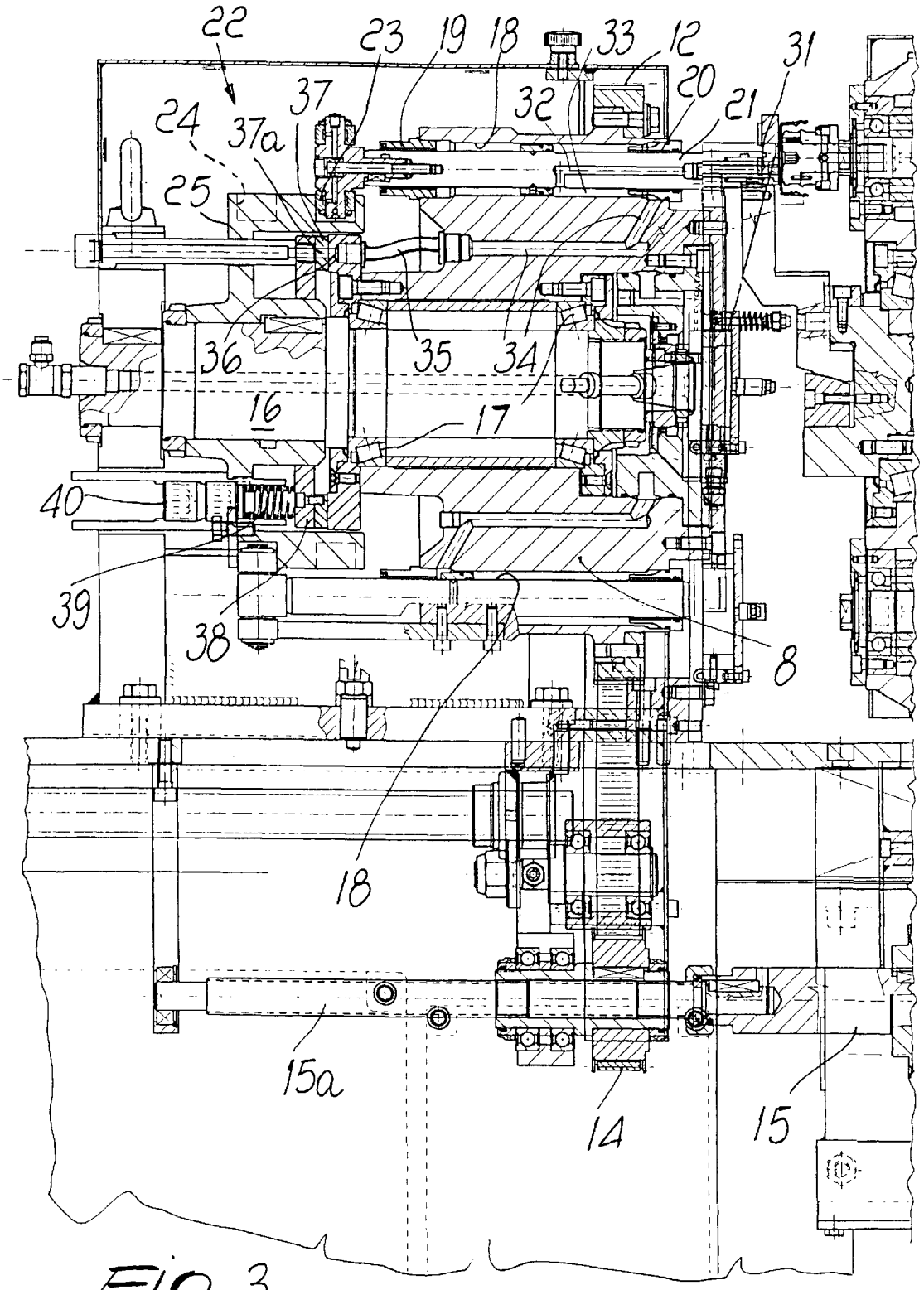
FIG. 3 is a sectional side view, taken along a diametrical plane, of the unit of FIG. 2.

With particular reference to the above figures, the reference numeral 1 generally designates a fast feeder unit of an automatic machine 2 for machining the cylindrical surface of bottle closure caps C according to the invention.

The machine 2 and the feeder unit 1 are supported in a sturdy frame 3 composed of uprights, longitudinal members, and cross-members that are welded together: the automatic machine 2 is provided, in a downward region, with a motor 4 for actuating a continuously rotatable carousel 5, whereon a plurality of chucks 6 is mounted and actuated so that they can rotate; said chucks are distributed annularly with a constant pitch, and the caps C to be machined are fitted thereon; a plurality of machining heads is associated in a known manner with the fixed part of the machine with the purpose of performing the desired machining operations on the outer surface of the caps.

The unit 1 is constituted by a feeder carousel 8 provided with means for support and rotary actuation coaxially to, and in step with, the carousel 5.

The supporting means of the carousel 8 comprises a slider 9 whereon the carousel is fixed; said carousel is slidingly mounted and can be conveniently actuated by a threaded crank 10 along lateral guides 11 that are orientated parallel to the axis of the machine. This allows, when the machine is at rest, handy access for machine maintenance and set up.

The means for rotatably actuating the carousel 8 comprises an external peripheral set of teeth 12 of the feeder carousel, which is coupled by means of a toothed belt 13 to a pinion 14 slidingly mounted along the extension 15*a* of a horizontal shaft 15 for motorizing the carousel of the machine 2.

The carousel 8 is rotatably supported about a horizontal shaft 16 rigidly coupled to the frame 3 by means of bearings 17 and peripherally crossed by a plurality of cylindrical seats 18 for the longitudinal sliding, made hermetic by means of gaskets 19 and 20, of respective stems 21 which are substantially axially aligned with the chucks 6.

The stems 21 have axial translatory motion means 22 constituted by respective freewheeling rollers 23 the axes whereof lie at right angles to the axes of the respective stems and engage an annular cam profile 24 formed in a drum 25 that is fixed to the shaft 16 by means of a key; the cam profile 24 has two respective half-waves 24*a* and 24*b* at the regions for fitting and removing the caps on and from the chucks.

The height of the half-waves is substantially similar to the height of the caps that must be fitted on the chucks.

The slidable stems 21 direct towards the chucks respective cap supporting half-shells 26; said half-shells are constituted by a semicircular base 27 with a rim 28 that covers a little over 90 degrees and is arranged to the rear with respect to the rotational direction, arrow A, of the carousel.

A guide 29 for feeding the caps to be machined and a guide 30 for removing the machined caps are provided at a front vertical plane proximate to the feeder carousel; the guides 29 and 30 are fixed, lie horizontally, and their respective cap outlet and inlet openings are aligned with the path of the half-shells 26; advantageously, the guide 29 is orientated towards the axis of the carousel, whereas the underlying guide 30 is substantially tangent to the carousel and is offset by approximately 270 degrees with respect to the guide 29.

The axial translatory motion means 22 carry, in sequence, each one of the half-shells 26 from a position that is spaced from the respective chuck 6 and co-planar to the openings of the guide 29 to a position for fitting a cap on the chuck and for releasing it thereon (half-wave 24*a*): then, after the intended machining operations have been performed on the cap, the half-shell 26 moves back towards the respective chuck, removes the cap from the chuck, and deposits it on the guide 30 (half-wave 24*b*).

In order to facilitate the grip and release of the caps on the part of the half-shells, the slidable stems and the half-shells are hermetically crossed by suction (and blowing) holes 31 and 32 connected to an air distribution system that comprises, for each stem 21, a cylindrical chamber 33 formed in the body of the carousel and in which the stem slides hermetically; said chamber is connected, through openings 34 of the carousel body and by virtue of flexible connectors 35, to respective openings 36: said openings 36 slide hermetically against a fixed ring 37 that rests hermetically against a fixed base 38, and tightness is ensured by a plurality of spring-loaded pressers 39 the pressing force whereof can be adjusted by means of screws 40.

Figure 5:
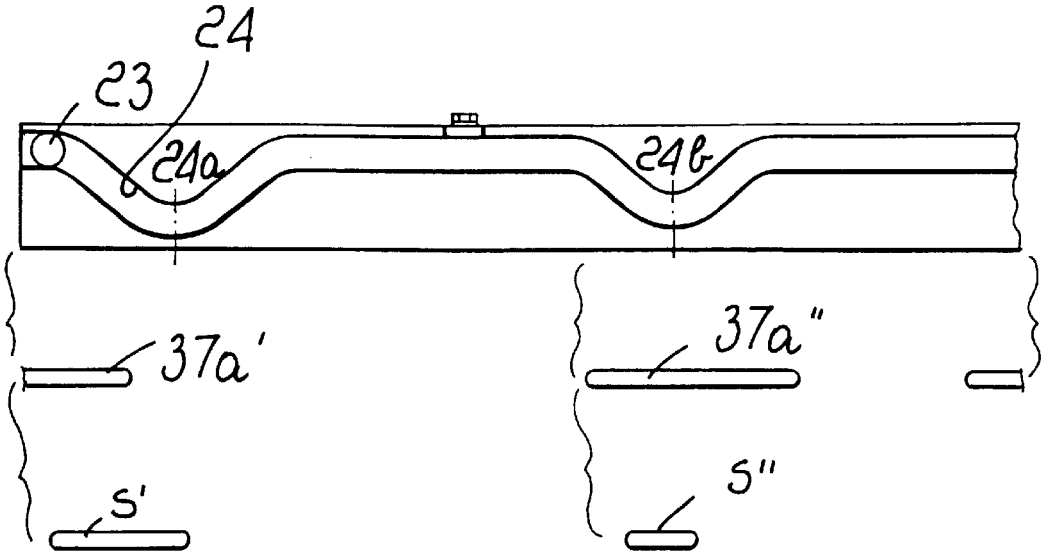
FIG. 5 is a schematic plane development view, of the profile shapes of some operating components of the unit.
Figure 4:
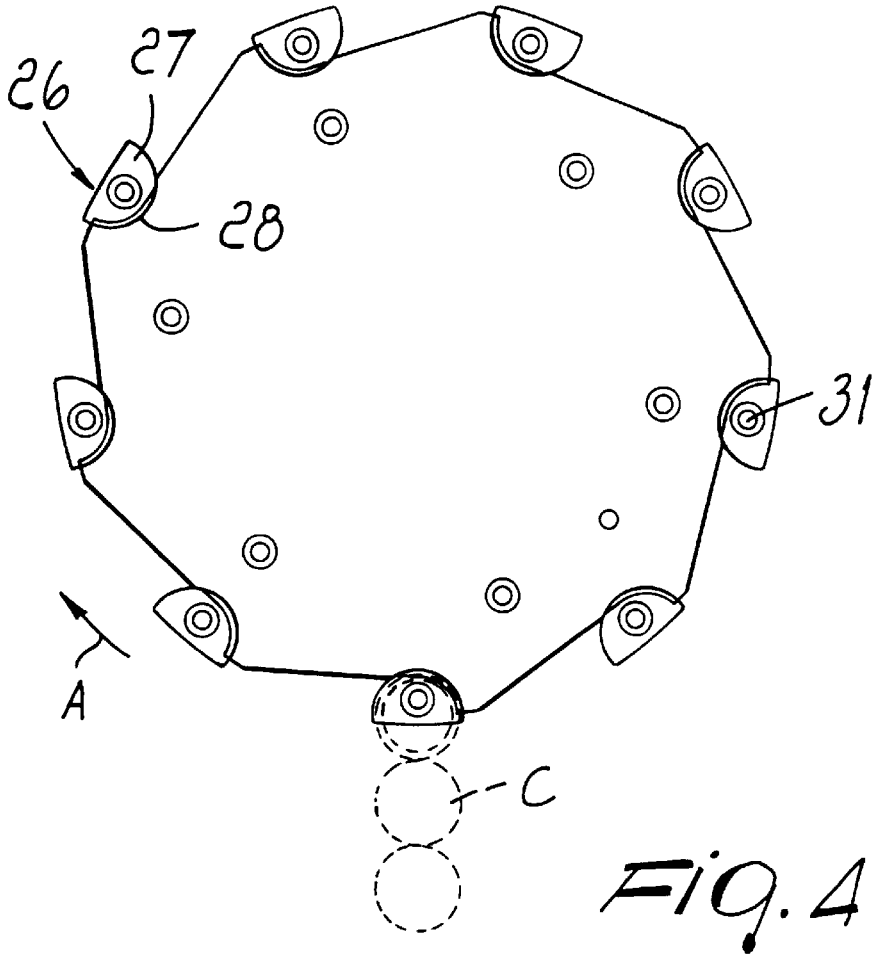
FIG. 4 is a schematic front view of the carousel of the unit.
Figure 6:
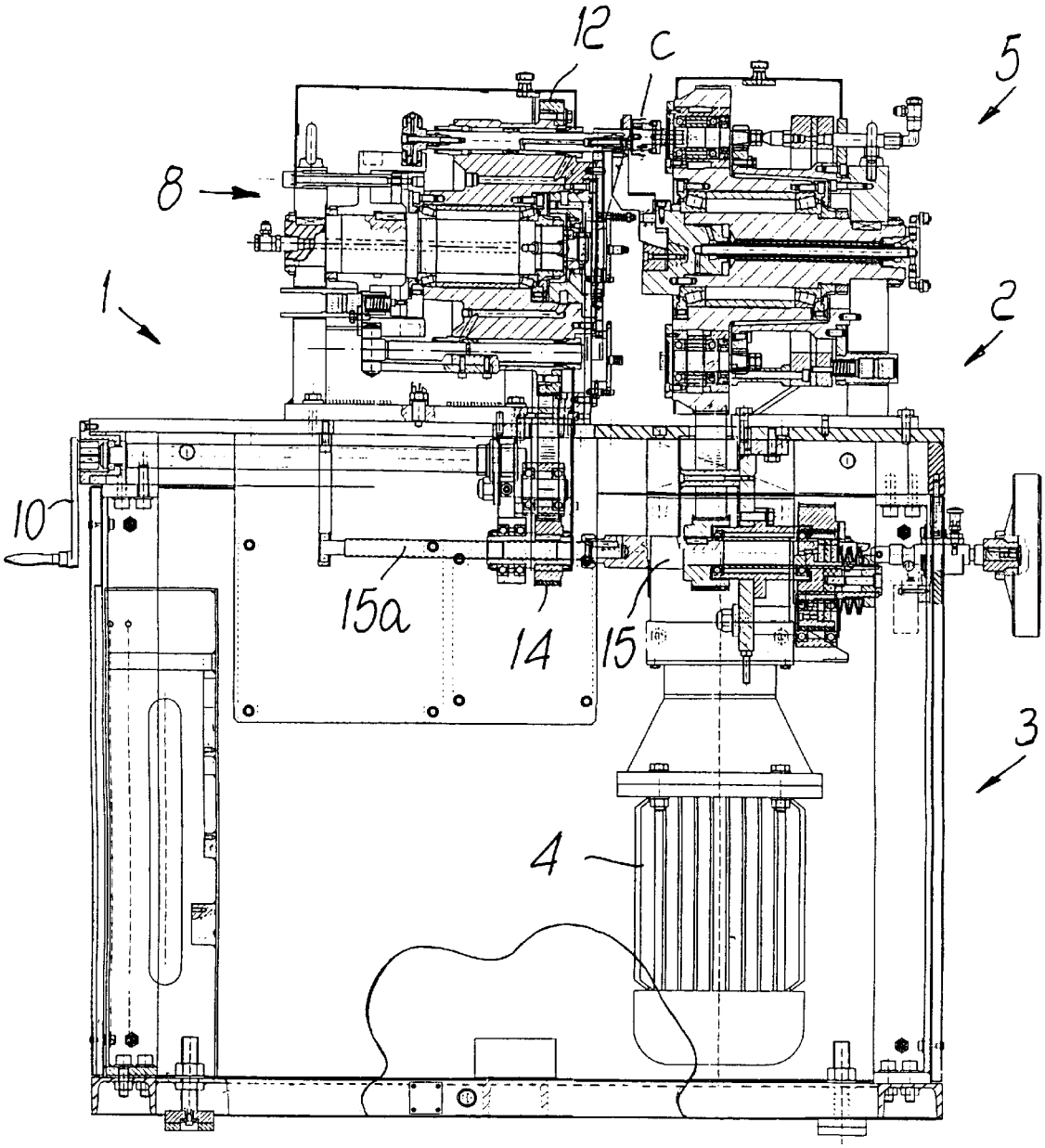
FIG. 6 is a sectional side view of a machine for machining caps, equipped with a feeder unit according to the invention.

The ring 37 of the air distribution unit has suction connection slots 37*a* at the regions for fitting and removing the caps on and from the chucks; the slot of the fitting region is interrupted halfway along a wave for releasing the cap on the chuck: the timing of the suction regions with respect to the half-waves 24*a* and 24*b* is designated by the reference numerals 37*a'* and 37*a'* in FIG. 5; advantageously, the chucks 6 are in turn connected to a compressed air distribution unit adapted to emit a jet for expelling the cap retained on the chuck at the steps designated schematically in FIG. 5 by s' and s".

The operation of the unit according to the invention is easily understandable: in practice, each half-shell 26, by skimming the opening of the guide 29, picks up a cap C, which is kept in position by the suction applied through 37*a'*: the half-shell is moved towards the respective chuck (cam profile 24*a*) and fits the cap thereon, releasing it in the point of maximum approach (suction through 37*a'* ceases), the half-shell moves away from the chuck, and the operating elements of the machine for machining the cap act to perform the various machining operations: once the machining operations have been performed, the roller 23 is in the region 24*b* of the cam profile 24 and the half-shell 26 again moves towards the chuck to pick up the machined cap C, removal being assisted by the suction through the slot 37*a"*; then, by passing in front of the opening of the guide 30, the half-shell 26 propels the cap tangentially and is assisted in doing so by optional air jets.

The individual caps are moved without any sliding against shaped profiles, and this avoids damage to the caps and allows very fast feeding even of caps that are very tall with respect to their diameter.

The unit according to the invention has been shown and described with the axis of the carousels 5 and 8 arranged horizontally; in any case, the axis of said carousels 5 and 8 may also be vertical and in this case the feeder unit is preferably located below the carousel of the machine.

It has thus been shown that the invention achieves the intended aim and objects.

The invention thus conceived is susceptible of numerous modifications and variations, all of which are within the scope of the inventive concept.

All the details may furthermore be replaced with other technically equivalent elements.

In practice, the materials employed, as well as the shapes and the dimensions, may be any according to the requirements without thereby abandoning the scope of the protection of the appended claims.

What is claimed is:

1. A fast feeder unit for an automatic machine for machining the cylindrical surface of bottle closure caps, comprising a continuously rotatable carousel whereon a plurality of annularly distributed chucks is rotatably mounted so as to rotate about an axis of the machine, the caps to be machined being fitted on said chucks, said unit comprising: a feeder carousel; means for supporting and rotationally actuating said feeder carousel coaxially and in step with said rotatable carousel of the machine; a plurality of axially slidable stems being mounted on said feeder carousel; respective half-shells arranged on said feeder carousel, at said sliding stems, for supporting the caps, said stems directing said half-shells towards said chucks; respective axial translatory motion means for actuating said sliding stems so as to move the half-shells from a position that is spaced from the chucks and co-planar to an opening of a fixed guide for feeding the caps to be machined and to an opening of a fixed guide for removing the machined caps, to a position for fitting a cap on the chuck and a position for removing the cap from the chuck.

2. Unit according to claim 1, wherein said means for supporting said feeder carousel comprises a slider whereon said feeder carousel is fixed, said feeder carousel being mounted so as to be slideable and actuatable, through a crank means, along slider guides, said slider guides being orientated so as to be parallel to the axis of the machine to allow machine access and maintenance.

3. Unit according to claim 1, wherein said means for rotary actuation of said carousel comprises an external peripheral set of teeth of the feeder carousel, said set of teeth being coupled, through a toothed belt, to a pinion, said pinion being slideably mounted along a driving shaft of the rotatable carousel of the machine.

4. Unit according to claim 1, wherein said sliding stems and said half-shells are crossed by hermetically sealed suction holes, said suction holes being connected to an air distribution unit for performing gripping of bottoms of the caps.

5. Unit according to claim 4, wherein said axial translatory motion means are constituted by respective freewheeling rollers with axes whereof lying at right angles to axes of respective said stems, said rollers engaging an annular cam profile, said cam profile having two respective half-waves at regions for fitting on, and removing the caps from the chucks.

6. Unit according to claim 5, wherein said air distribution unit has suction connection slots, said slots being provided at the regions for fitting and removing the caps on and from the chucks, a slot of a fitting region being interrupted halfway along the half-wave to release the cap onto the chuck.

7. Unit according to claim 1, wherein said rotatable and feeder carousels of the machine rotate coaxially about an axis thereof which is horizontal.

8. Unit according to claim 1, wherein said rotatable and feeder carousels of the machine rotate coaxially about an axis thereof which is vertical, the feeder unit being located below the rotatable carousel of the machine.

* * * * *